United States Patent [19]

Moore, Jr.

[11] 4,125,241

[45] Nov. 14, 1978

[54] LOCKING PLATE MEMBERS FOR USE IN SYSTEM FOR OVERHEAD SUPPORT OF WEIGHTED ARTICLES

[75] Inventor: Junius T. Moore, Jr., Charleston, W. Va.

[73] Assignee: The Moore Company, Charleston, W. Va.

[21] Appl. No.: 775,413

[22] Filed: Mar. 7, 1977

[51] Int. Cl.[2] ..... E05B 65/48

[52] U.S. Cl. ..... 248/320; 24/116 R; 70/2; 248/203

[58] Field of Search ..... 248/320–322, 248/327, 332, 203; 211/117; 70/2, 6, 18, 63, 49, 30; 59/86, 93; 24/116 R; 403/398, 399, 386, 291

[56] References Cited

U.S. PATENT DOCUMENTS

| | | | |
|---|---|---|---|
| 677,188 | 6/1901 | Drees | 24/116 R X |
| 956,245 | 4/1910 | White et al. | 248/320 |
| 1,154,818 | 9/1915 | Van Dorn | 248/320 |
| 1,370,981 | 3/1921 | McGowan | 211/117 X |
| 2,179,564 | 11/1939 | Smith | 24/116 R |
| 2,249,238 | 7/1941 | Gilmore | 59/86 X |
| 2,676,373 | 4/1954 | Meeker | 24/116 R X |
| 2,962,253 | 11/1960 | Moore | 248/320 |
| 3,939,677 | 2/1976 | Drayton | 70/18 X |
| 4,027,989 | 6/1977 | Pierce | 24/116 R X |

FOREIGN PATENT DOCUMENTS

| | | | |
|---|---|---|---|
| 489,033 | 7/1938 | United Kingdom | 24/116 R |
| 671,413 | 5/1952 | United Kingdom | 24/116 R |

*Primary Examiner*—Rodney H. Bonck

*Attorney, Agent, or Firm*—Cushman, Darby & Cushman

[57] ABSTRACT

An improved safety system for raising, lowering and supporting in an elevated or lowered position, a weighted article from an overhead support. The system includes a link chain passing over a safety pulling member, the link chain having one end permanently connected to the weighted article and the other end permanently connected to an attachment means positioned within reach of a person so that the person may pull the link chain downwardly to raise the weighted article to a desired elevation out of range of the person. The link chain has an improved locking member thereon which may be detachably attached to and locked to the attachment means. The locking member, once installed on the link chain at the proper position, is tamper proof and substantially break proof. The weighted article may be a clothes basket, or other receptacle, or any article in which it is desired to selectively suspend overhead out of reach of a person and then lower within range of a person.

5 Claims, 6 Drawing Figures

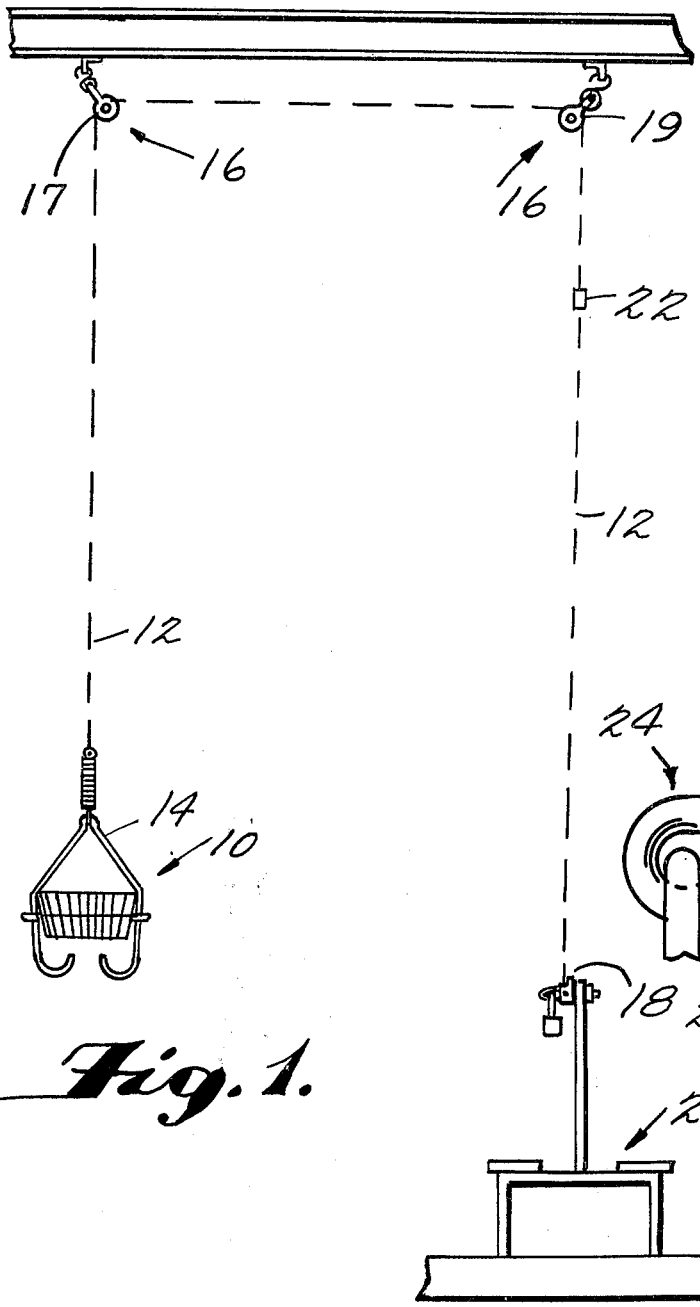
Fig. 4.
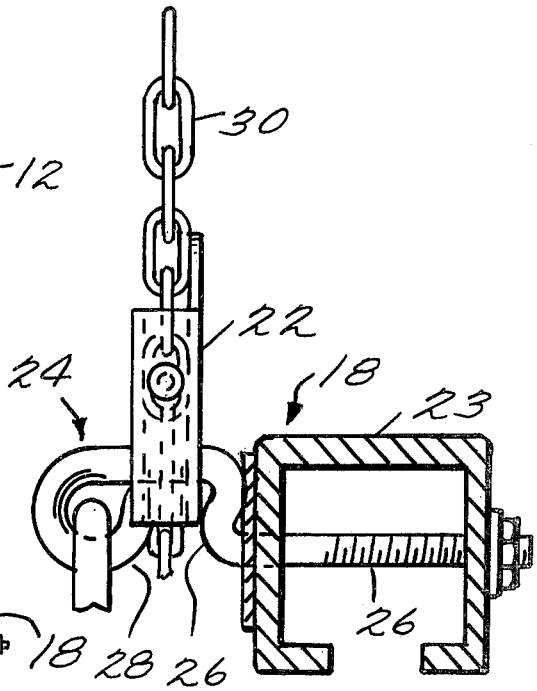
Fig. 1.
Fig. 5.
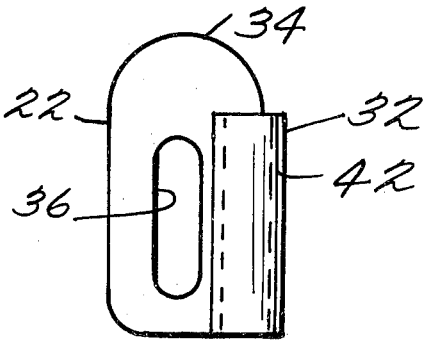
Fig. 6.
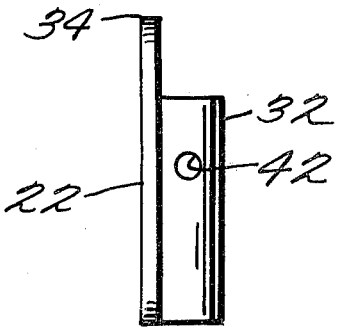

Fig. 2.
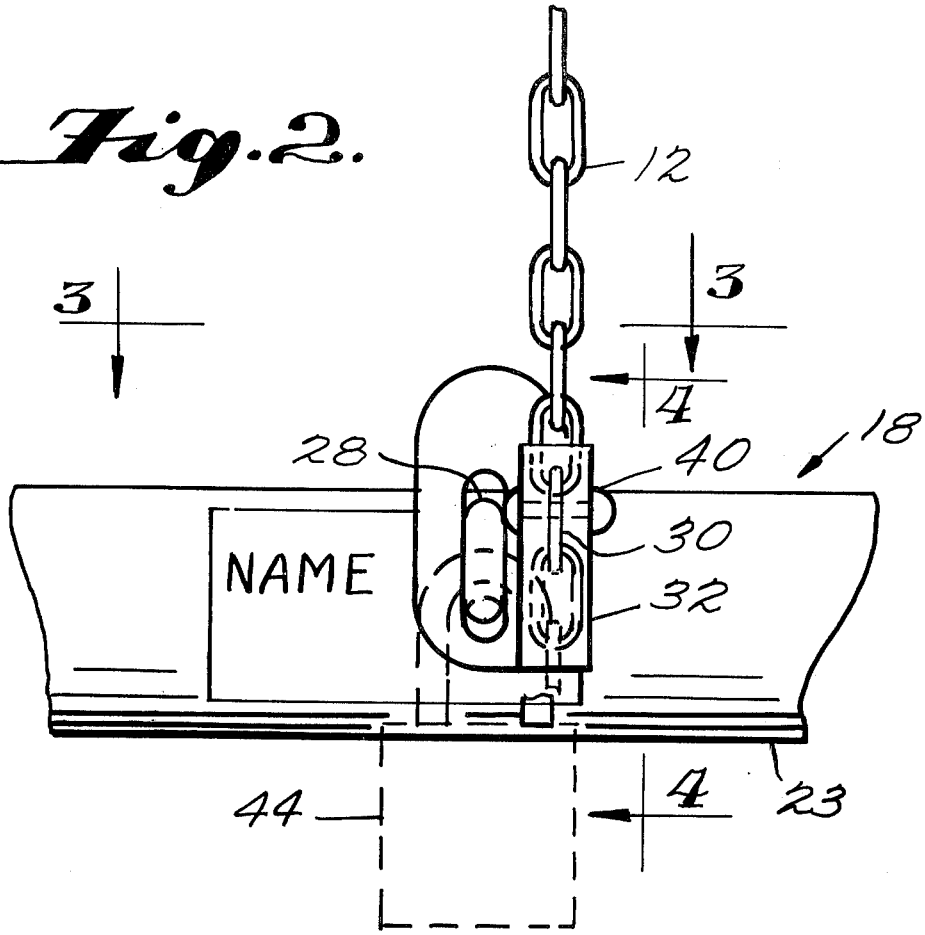
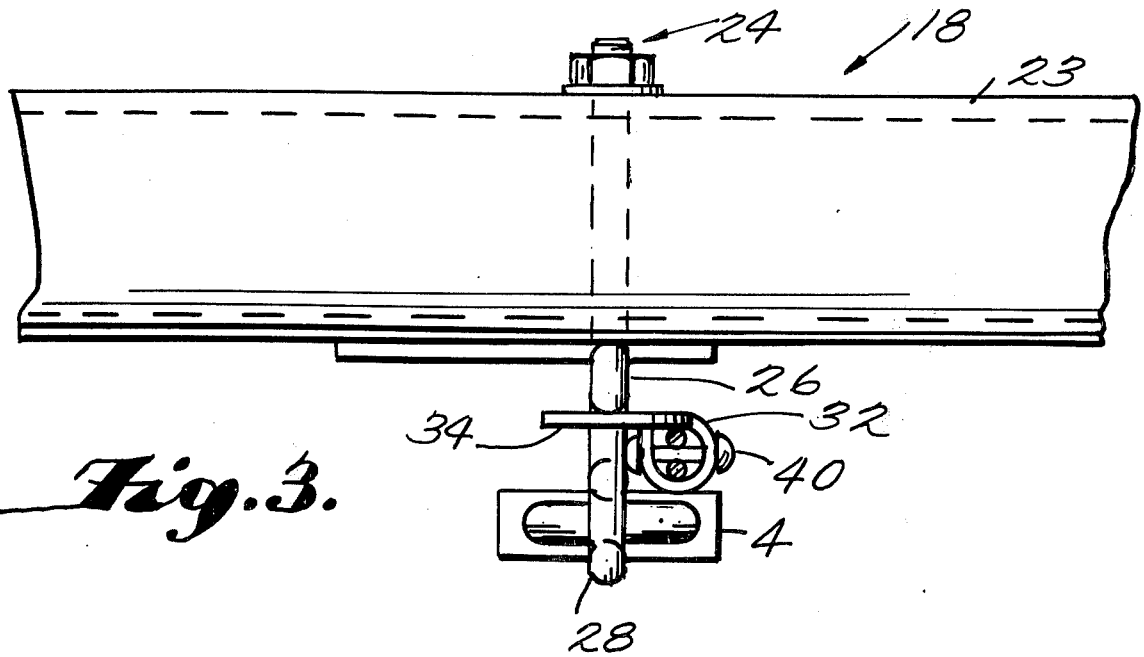
Fig. 3.

LOCKING PLATE MEMBERS FOR USE IN SYSTEM FOR OVERHEAD SUPPORT OF WEIGHTED ARTICLES

The present invention relates to an improved safety system for suspending a weighted article from an overhead support means, the system being capable of lowering or raising the article when desired. More specifically, the present invention relates to an improved link chain for such a system, the link chain being provided with an improved locking member thereon permanently positioned at a predetermined place on the link chain, the locking member being capable of attachment to and locking on an attachement means supported within range of a person.

BACKGROUND OF THE INVENTION

In the prior U.S. Pat. No. 2,962,253 issued Nov. 29, 1960 to Junis T. Moore, Jr. and having a common assignee to this application, namely, The Moore Company of Charleston, W. Va., there is disclosed a system for storing clothing and/or other articles by utilizing a receptacle such as shown in U.S. Pat. No. 2,620,074 issued Dec. 2, 1952 to Junis T. Moore, Jr. and also assigned to the common assignee. The receptacle is supported on the end of a link chain and passes over a pulley arrangement fixed to an overhead support member and then passes downwardly and has its other end attached to fixed attachment means which is positioned within reach of a person. In the system shown in the aforementioned U.S. Pat. No. 2,962,253, when the link chain is fully extended it has a length sufficient to support the receptacle within range of a person. However, the link chain may be pulled downwardly to elevate the receptacle, the chain having an enlarged locking link thereon which is detachably received by and locked to the attachment means so as to support the receptacle in an elevated position out of range of the person. This type of system has found widespread use in locker rooms of industrial and manufacturing plants for hanging clothes and storing articles such as shoes, helmets or the like where it is desirable to provide a clean and airy locker room with a maximum of floor space. While the system disclosed in the aforementioned U.S. Pat. No. 2,962,253 has found widespread use throughout industrial and manufacturing plants, it is not entirely satisfactory at this time because of the increasing demands for safety in all phases of operation.

In view of safety standards set up by various municipal, state and federal governments in recent years, the system such as described in the aforementioned U.S. Pat. No. 2,962,253 was substantially improved by the use of safety pulleys such as disclosed in the copending U.S. application Ser. No. 658,051 filed Feb. 13, 1976 by Junis Thomas Moore and also assigned to the Moore Company, Inc. In application Ser. No. 658,051, the use of a safety pulling member prevented sudden dropping of the weighted article or receptacle by a sudden relaxing of tension in the link chain or by failure of the link chain between the safety pulley member and the fixed attachment means. While the invention of application Ser. No. 658,051 has materially enhanced the safety of systems such as disclosed in the aforementioned U.S. Pat. No. 2,962,253, there still remains a possibility of the link chain breaking between the pulley means and the fixed attachment means, especially in the area where the locking link was positioned. In the distribution of these systems, the manufacturer supplies sufficient length of chain for various elevations of overhead support means and further supplies an open locking link. When the system is installed in a plant, the personnel in the field cut the link chain at the plant where the locking link was to be installed and then the locking link was installed and closed and supposedly welded. However, oftentimes personnel in the field would fail to weld the link and merely close the link or if they did weld the link, the weld was a faulty weld due to the inexperience of personnel installing such links. When the enlarged locking link had a faulty weld or when the enlarged locking link was not welded, it oftentimes would open due to rough handling thus causing the weighted article to radidly drop to the floor and possibly injure personnel. Additionally, by having a locking link which was not welded, the system was not fully tamper proof as someone could perhaps open the locking link and thus obtain access to the stored articles.

BRIEF SUMMARY OF THE INVENTION

The present invention relates to an improvement in a system for raising and lowering a weighted article between supported elevated and supported lower positions and it comprises an overhead support means carrying pulley means. Fixed attachment means are provided within reach of a person, the fixed attachment means including a locking bolt means having a shank portion and an enlarged looped end portion. A link chain fixedly connected at one end to the weighted article passes vertically upwardly over the pulley means and extends downwardly and is permanently connected at its other end to the attachment means, the link chain having a length when fully extended sufficient to permit the article to be suspended within range of a person and the chain having links with apertures too small to fit over the enlarged looped end portion of the bolt means. Means are provided on the chain at a predetermined distance from the end of the chain connected to said attachment means, the means being adapted to be detachably attached to the bolt means when the chain is drawn downwardly to raise the article to the elevated position. The means on the chain positioned at a predetermined distance from the end of the chain includes a locking member having a tubular body portion of a size sufficient to slide axially of said link chain, the tubular body portion extending around the link chain and provided with a planar plate portion integral therewith and projecting laterally therefrom. The planar plate portion has an elongated aperture therethrough of sufficient size to slip over the enlarged looped end portion of the bolt means and then means are provided to anchor the tubular body portion at the permanent position on the chain.

In the specific improvement of the locking member, the means to permanently anchor its tubular body portion to the link chain includes a rivet extending transversely through the tubular body portion and through an aperture in one of the links of the chain, the rivet being anchored at its ends to the tubular body portion.

A further feature of the present invention is to provide the elongated aperture in the planar plate portion having a major axis substantially parallel to the axis of the tubular body portion of the locking member.

An additional feature of the present invention is to make the locking member an integral unit with the planar plate portion extending laterally from and integral with one of the longitudinal edges of the tubular body.

These and other features and advantages of the present invention will become more apparent in the detailed discussion which follows and in that discussion reference will be made to the accompanying drawings as briefly described below.

BRIEF DESCRIPTION OF THE DRAWINGS

FIG. 1 is a schematic view of the improved system of the present invention installed in a locker room, the view illustrating the weighted article in the lowered supported position.

FIG. 2 is an enlarged fragmentary side elevational view of the present invention and illustrating the link chain moved downwardly from the position shown in FIG. 1 and locked to the fixed attachment means.

FIG. 3 is a top plan view of FIG. 2 taken on the line 3—3.

FIG. 4 is an enlarged sectional view taken substantially on the line 4—4 of FIG. 2 but showing certain parts in elevation.

FIG. 5 is a front elevational view of the locking member of the present invention, and FIG. 6 is a side elevational view looking from the left to the right of FIG. 5.

DETAILED DESCRIPTION OF THE INVENTION

Referring now to the drawings wherein like characters or reference numerals represent like or similar parts, the safety system of the present invention is shown overall in FIG. 1 and it includes a weighted article 10, which may be a receptacle or basket of the type disclosed in the aforementioned U.S. Pat. No. 2,620,074, and a link chain 12 permanently secured at one end to the bail-like handle 14 of the article 10. The link chain 12 extends vertically upwardly over a pulley means generally designated at 16 and then downwardly and is permanently connected at its other end to a fixed attachment means 18 supported within range of a person. The pulley means 16 may include a first pulley member 17 and a laterally spaced second pulley member 19. The pulley member 17 may be of the type disclosed in the aforementioned application Ser. No. 658,051 and the subject matter of this application is incorporated herein by reference.

The fixed attachment means 18 may be a horizontal bar 23 or the like such as disclosed in U.S. Pat. No. 3,673,719 issued July 4, 1973 to Junis T. Moore, Jr. and it may be suitably supported on a fixed structure 20 or a wall. In the position shown in FIG. 1, the weighted article 10 is shown supported at a lowered position within reach of a person utilizing the same and it will be evident that the link chain 12 has its length shown in its fully extended position, from its point of connection to the article 10 to its point of permanent connection to the attachment means. However, the link chain 12 is provided with a locking member 22 at a predetermined spaced distance from its point of connection to the fixed attachment means 18 and, thus, when the chain is pulled downwardly in order to raise the weighted article 10, the locking member 22 travels downwardly until it is at a position adjacent the fixed attachment means 18. It can then be detachably secured to the fixed attachment means and locked in position so that the elevated article 10 is out of reach of a person.

Referring now to FIGS. 2 through 6 inclusive, it will be noted that the fixed attachment means 18 includes the horizontally extending rail 23 through which a bolt means 24 extends. In more detail, the bolt means 24 has a shank portion 26 which terminates at one end in a looped end 28, the size of the looped end 28 being greater than the individual apertures of the links 30 of link chain 12. As mentioned, the structure of the fixed attachement means 18 may be identical to that disclosed in the aforementioned U.S. Pat. No. 3,673,719 and to that extent the disclosure of this patent is incorporated by reference herein.

In the present invention and at the time the system is installed in a locker room or the like, the locking member 22 is threaded on to the link chain 12 and is movable thereon until permanently fixed at its proper position and, thus does not require cutting of the chain at a particular point and then inserting an enlarged locking link therein as in the prior art. In the present invention the locking member 22 includes a tubular body portion 32 having an inside diameter of sufficient size to permit the links 30 of the link chain 12 to be easily threaded therethrough and, as shown in FIGS. 2 and 4, having an axial length sufficient to maintain the same coaxial with the link chain 12. Additionally, the locking member 22 includes a planar plate portion 34 extending integrally from one edge of the tubular body portion, the planar plate portion 34 having an elongated uninterrupted aperture 36 of sufficient length and width to extend over the enlarged looped end 28 of the bolt means 24. The aperture 36 has its major axis generally parallel to the longitudinal axis of the tubular body portion 32. Locking member 22 is fabricated from a single piece of sheet steel approximately 1/16 of an inch thick and is then subsequently galvanized. The locking member thus has a strength at least equal to the strength of an individual link 30 of the link chain 12.

As previously mentioned, the locking member 22 is threaded onto the chain and when the proper length of chain has been determined to support the basket in the lowermost position, the free end of the chain is permanently attached to the fixed attachment means in any suitable manner. Once this has been accomplished, then it is necessary to determine the position where the locking member 22 is to be permanently secured to the link chain 12. This is accomplished by pulling the link chain downwardly until the weighted article 10 is elevated to the desired elevation out of reach of an individual and when this is done, the locking member 22 is slid along the chain to a position adjacent the fixed attachment means 18. A rivet 40 is then inserted through the holes 42 provided in the tubular body portion 32 of the member 22 and as best shown in FIGS. 2, 3 and 4, the rivet 40 will also extend through the aperture in one of the links 30 of the link chain 12.

The drive rivet 40 after it is placed through the holes in the tubular body portion 32 is then set so that it is permanently fixed at its end to the body portion 32 and thus cannot be removed. This arrangement locking member 22 provides a system which is tamper proof and is substantially break proof especially since the locking member is an integral unit and the aperture in the locking member is completely enclosed. Additionally, this arrangement provides a chain which is not weakened by substitution of a special locking link therein which is often improperly installed.

It will be noted that a conventional lock 44 may be used to lock the locking member 22 on the bolt member 24 to thus secure the article 10 in the elevated position.

The terminology used in this specification is for the purpose of description and not limitation as the scope of the invention is defined in the claims.

What is claimed is:

1. In a system for raising and lowering a weighted article between supported elevated and supported lower positions, the combination comprising:

an overhead support means;

pulley means supported from said overhead support means;

fixed attachment means supported within range of a person, said fixed attachment means including a locking bolt means having a shank portion and an enlarged looped end portion;

a link chain connected at one end to the article and passing vertically upwardly over said pulley means and extending downwardly and permanently connected at its other end to said attachment means, said link chain having a length when fully extended sufficient to permit said article to be suspended within range of a person and said chain having links with apertures too small to fit over the enlarged looped end portion of said bolt means; and means on said chain positioned a predetermined distance from the end of said chain connected to said attachment means, said means being adapted to attach said chain to said bolt means when said chain is drawn downwardly to raise the article to the elevated position;

the improvement in said means adapted to attach said chain to said bolt means including a locking member having a tubular body portion of a size sufficient to slide axially over said link chain, the tubular body portion extending around said link chain and having an axial length sufficient to maintain the tubular body substantially coaxial with said link chain, a planar plate portion integral with said tubular body portion and projecting laterally therefrom, said planar plate portion having an elongated aperture therethrough of size sufficient to slip over the enlarged loop end portion of said bolt means, said plate portion having an edge adjacent said aperture curved back on itself to form said tubular body portion and means to anchor said tubular body portion permanently to said link chain without affecting said link chain's integrity at the predetermined distance from the end of said chain.

2. A system as claimed in claim 1 including a locking means for locking said locking member on said locking bolt means to thereby lock said weighted article in a supported elevated position.

3. The system as claimed in claim 1 in which said means to anchor said tubular body includes a second aperture through said plate portion defining said tubular body portion.

4. A system as claimed in claim 3 in which said means to permanently anchor said tubular body portion to said link chain includes a rivet extending transversely through said second aperture in said tubular body portion and through an aperture in one of the links of said chain, said rivet being anchored at its ends to said tubular body portion.

5. A system as claimed in claim 4 in which the elongated aperture in said planar plate portion has a major axis substantially parallel to the axis of said tubular body portion.

* * * * *

UNITED STATES PATENT OFFICE

CERTIFICATE OF CORRECTION

Patent No. 4,125,241 Dated November 14, 1978

Inventor(s) Junius T. Moore, Jr.

It is certified that error appears in the above-identified patent and that said Letters Patent are hereby corrected as shown below:

Please change "[73] Assignee: The Moore Company, Charleston, W. Va." to

--[73] Assignee: The Moore Company, Inc., Charleston, W. Va.--

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*